United States Patent [19]

Lagher

[11] 4,406,147

[45] Sep. 27, 1983

[54] PIPE-BENDING APPARATUS

[75] Inventor: Gunnar H. Lagher, Fjälkinge, Sweden

[73] Assignee: A.O. Arkitektkontor AB, Stockholm, Sweden; a part interest

[21] Appl. No.: 303,026

[22] Filed: Sep. 17, 1981

[30] Foreign Application Priority Data

Sep. 23, 1980 [SE] Sweden ..... 8006647

[51] Int. Cl.[3] ..... B21D 9/05

[52] U.S. Cl. ..... 72/383; 72/389

[58] Field of Search ..... 72/389, 386, 383, 370, 72/380, 466, 398

[56] References Cited

U.S. PATENT DOCUMENTS 1,903,436 4/1933 Brown ..... 72/388
2,528,315 10/1950 Martin ..... 72/398
3,209,570 10/1965 Hills ..... 72/387

FOREIGN PATENT DOCUMENTS 328256 9/1975 Sweden .

*Primary Examiner*—Gene Crosby
*Attorney, Agent, or Firm*—Young & Thompson

[57] ABSTRACT

An apparatus for bending a pipe about a fixed forming member serving as abutment has members gripping the pipe externally as well as two mandrels intended to come inside the pipe. Each mandrel has an end piece movably carried by one end, the end pieces being against each other inside the pipe at the beginning of bending. During the initial bending phase, each end piece is urged outwards from the bending center to expand the pipe to such an extent that after terminating bending, the pipe is given a circular cross section subsequent to a certain amount of return spring of the pipe wall.

5 Claims, 5 Drawing Figures

FIG. 2
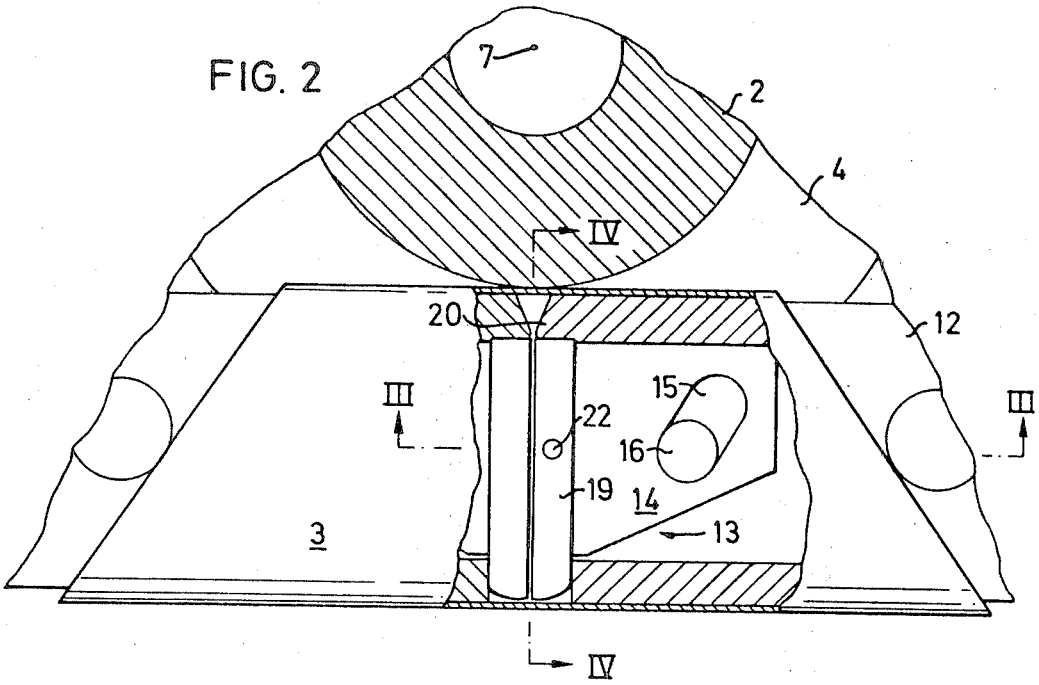
FIG. 3
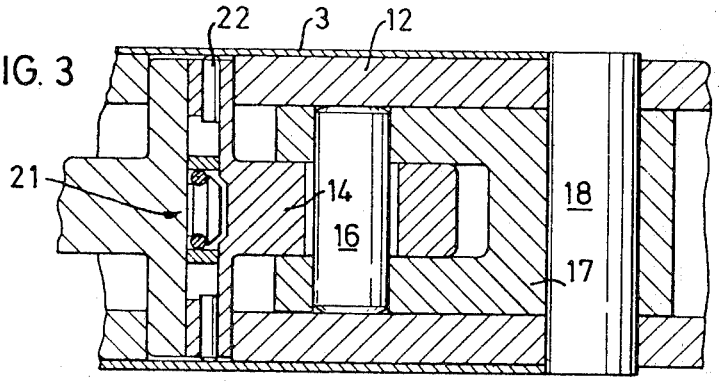
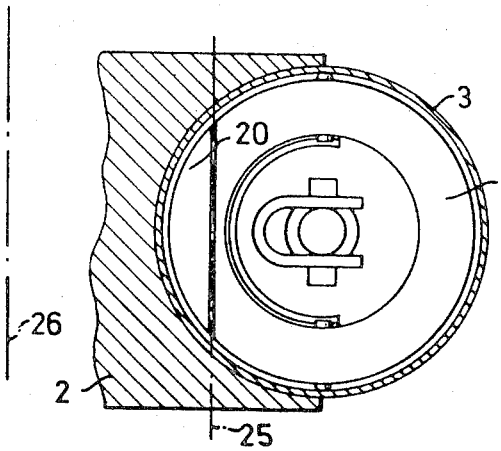
FIG. 4

PIPE-BENDING APPARATUS

The invention relates to an apparatus for bending pipe, with a fixed forming member serving as an abutment and two forming members pivotable in relation to the fixed forming member and intended for engagement with the pipe, each of the latter forming members being provided with a mandrel means having a movably arranged end piece at one end thereof, said mandrel means with their end pieces being intended for insertion in the pipe from opposing directions with the end pieces meeting each other, at the start of bending, to support the pipe from its interior during bending, said end pieces being adapted for remaining against each other during the initial bending phase while the respective mandrel means is swung a distance, and for then being swung together with the respective mandrel means.

An apparatus of this type is already known from the Swedish Pat. No. 328,256. However, it has been found in producing pipe bends with a bending radius of the same magnitude as the pipe diameter that it is not possible to obtain a circular cross section in the bend, and a certain amount of flattening on the outside of the bend is obtained.

The object of the invention is to provide an apparatus which is not burdened with these disadvantages, and which makes it possible to provide bends with a more circular cross section.

This is achieved in accordance with the invention by each end piece being adapted for displacement outwards away from the bending centre during an initial bending phase, to expand the pipe. By this expansion during the bending sequence itself, it will be possible to compensate the contraction taking place after terminated bending, which is due to stresses remaining in the pipe wall. The degree of expansion required in different cases will naturally depend on the bending radius, pipe dimensions and material of the pipe, and can be suitably adjusted from case to case.

A particularly simple embodiment is obtained when the end pieces are adapted for being given a displacement movement by means of the respective mandrel means.

Figure 1:
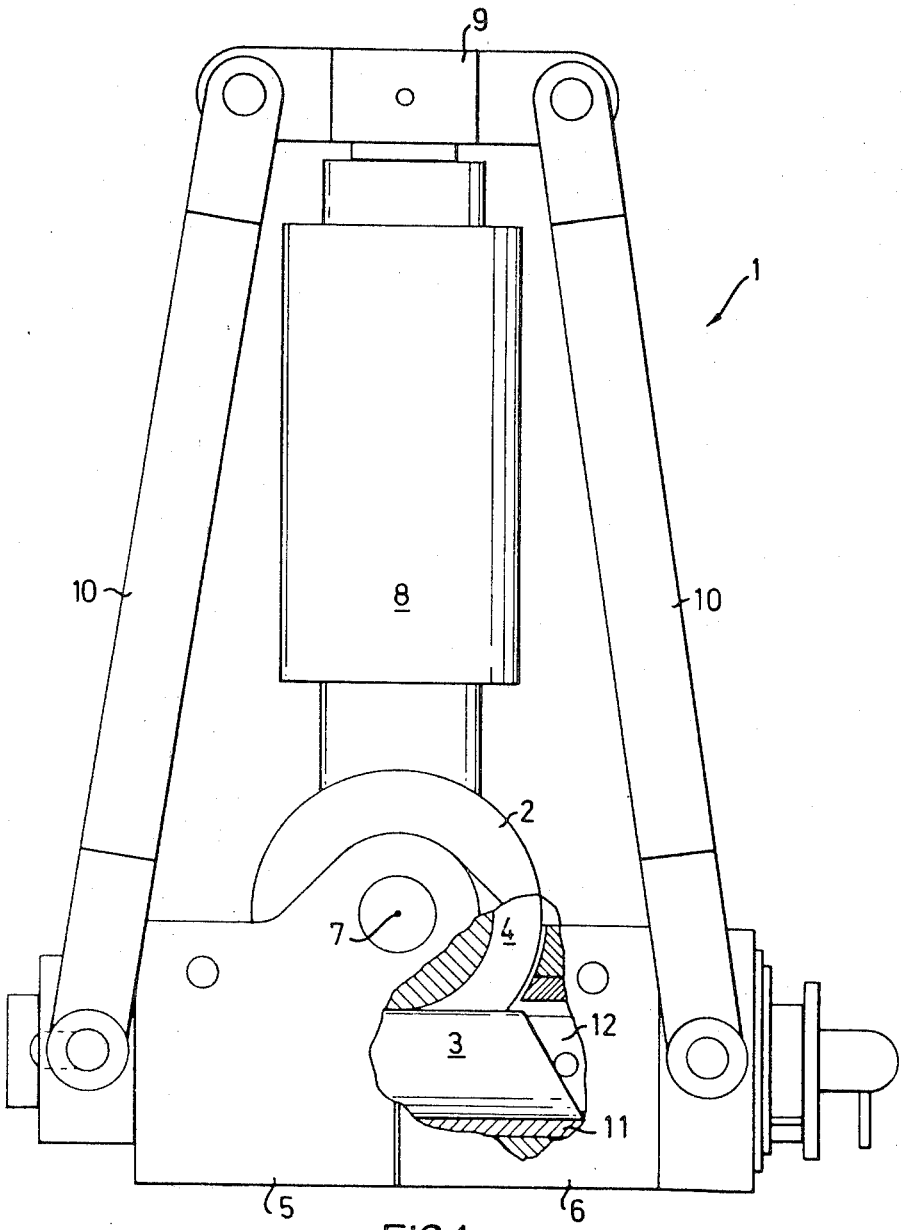
Figure 5:
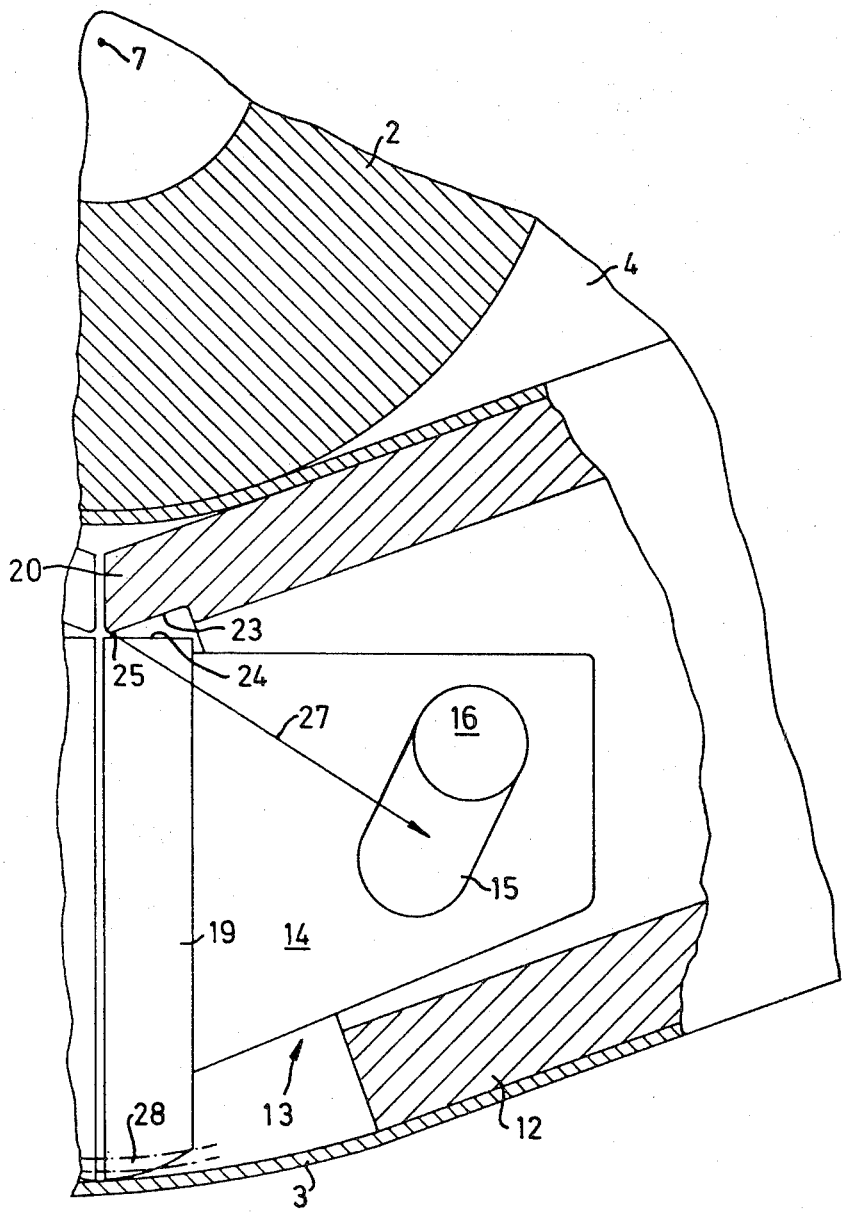

The invention will be explained in detail in the following with reference to an embodiment example shown in the appended drawings, where FIG. 1 schematically illustrates a complete apparatus in accordance with the invention, FIG. 2 illustrates in a simplified form a detail of the apparatus in FIG. 1, with the parts essential to the invention, before bending is started, FIG. 3 is a section along the line III—III in FIG. 2, FIG. 4 is a section along the line IV—IV in FIG. 2, and FIG. 5 illustrates a detail corresponding to FIG. 2, after bending has started.

An apparatus 1 according to FIG. 1, intended for cold-bending pipe, is already known to a large extent from the Swedish Pat. No. 328,256, mentioned in the introduction, the continued description therefore only bearing on details which are essential to the present invention.

A fixed forming member 2 is intended to constitute abutment for a pipe 3 which is to be bent, and is provided with a groove 4 of semi-circular cross section to suit the desired pipe bend. Two movable forming members 5 and 6 are pivotable about a bending centre 7 in the fixed member 2 and are each formed for interior and exterior engagement with the pipe 3. An operating cylinder 8, attached to the fixed forming member 2, can enable the movable forming members 5 and 6 to swing about the bending centre 7 to bend the pipe 3, the cylinder having for this purpose a yoke 9 with pivotally mounted links 10 respectively also pivotably mounted in the movable members 5 and 6. In each of the members 5 and 6 there is a support sleeve 11 for supporting the outside of the pipe 3, and a mandrel means 12 for supporting the inside of the pipe 3.

As will be seen from FIGS. 2–4, an end piece 13 is movably carried by the end of the means 12 inserted in the pipe 3, the means 12 being tubular, at least at this end. A guide portion 14 on the end piece 13 is provided with an arcuate guide slot 15, through which there passes a pin 16, which is mounted in a holder 17 arranged inside the means 12 and attached thereto by means of a retaining pin 18, the end portions of which projecting outside the means 12 being intended for contact with the obliquely cut ends of the pipe 3, as will be seen from FIG. 2. A substantially circular support portion 19 is secured to the guide portion 14 of the end piece 13 and is intended to be in contact along a major portion of its periphery with the inside of the pipe. The support portion 19 is substantially outside the means 12, but on its side facing towards the bending centre 7 it is formed to coact with an axially projecting portion 20 of the means 12.

The mutually opposing end pieces 13 are separably kept together in the position shown in FIGS. 2 and 3 by means of a suitably formed latching means 21, e.g. a locking pin on one of the end pieces 13 coacting with a suitable spring mechanism on the other end piece. The latching means 21 has the task of keeping the end pieces 13 together during an initial bending phase, and shall subsequently allow the end pieces to be moved apart when the force urging them apart is sufficiently great. At least one support portion 19 can further be provided with spring-loaded locating pins 22 to locate the support members at the axial centre of the pipe during the initial bending phase.

During bending, the end pieces 13 will alter attitude relative their respective mandrel means 12, as will be seen from FIG. 5, which shows the different parts at the end of an initial bending phase. The projecting portion 20 on the means 12 has a contact surface portion 23 facing away from the bending centre 7 for contact with a complementary contact portion 24 arranged on the support portion 19 of the end piece 13. The end piece 13 and the means 12 are mutually limitedly pivotable about a pivoting axis 25 (see also FIG. 4) situated in the contact area between said contact portions 23 and 24. This axis 25 is substantially parallel to a bending axis 26 (see FIG. 4) passing through the bending centre 7. The arcuate guide slot 15 in the guiding portion 14 of the end piece 13 has a radius of curvature 27 with its centre at the pivoting axis 25.

When the movable forming member 6 begins to swing about the bending centre 7, the pin 16 will gradually be displaced in the guide slot 15 from the position shown in FIG. 2 to that shown in FIG. 5. Simultaneously the end piece 13 is urged outwards with the aid of the projecting portion 20 of the means 12, and away from the bending centre 7, so that the pipe 3 is expanded with the aid of the support portion 19 of the end piece 13. In FIG. 5, dashed lines at 28 indicate what position the outer pipe wall would have had without expansion of the pipe. The size of the expansion required is naturally dependent on pipe dimensions and material and should be selected from case to case.

Upon continued bending from the position illustrated in FIG. 5, the two support portions 19 on the end pieces 13, which have so far been kept together, will be moved apart, while the respective end piece 13 and means 12 retain their illustrated mutual positions during the continued displacement inside the pipe. When a pipe is to be bent at an angle of 90°, each means 12 can be swung an angle of about 18°, for example, from the position shown in FIG. 2 to that shown in FIG. 5. After terminating bending, the expanded outer wall of the pipe springs back somewhat. By the expansion having a suitable size, the pipe can thus be given a circular cross section in the finished condition; something which has not been possible earlier.

In order to give thin-walled pipes with large diameter a bending radius of the same magnitude as their diameter and a bending angle as great as up to 90°, it is necessary to use short pipes to obtain suitable stress flow as well as to avoid ruptures and undesired deformations. The illustrated pipe 3 is intended to be bent an angle of 90° and is therefore initially provided with obliquely cut ends.

Coaction between the end piece 13 and the means 12 can naturally be accomplished in a manner other than that shown here, and it is possible by using another configuration of the contact portions 23 and 24, for example, to give the support portion 19 a quicker or slower outwardly directed movement as a function of the swing of the mandrel means 12. The end piece as well as the mandrel means can be made interchangeable, separately or together, to enable optimum adaption to the type of pipe which is being bent at the time.

One advantage with the described expansion of the pipe is that it is possible to have an initially larger clearance between the mandrel means and the pipe, which reduces the risk of the pipe moving sluggishly in the bending apparatus, and thereby giving rise to loss in time.

What I claim is:

1. In apparatus for bending pipe, with a fixed forming member serving as an abutment and two forming members pivotable in relation to the fixed forming member and intended for engagement with the pipe, each of the latter forming members being provided with a mandrel means having a movably arranged end piece at one end thereof, said mandrel means with their end pieces being adapted for insertion in the pipe from opposing directions with the end pieces meeting each other, at the start of bending, to support the pipe from its interior during bending, said end pieces being adapted to remain against each other during the initial bending phase while the respective mandrel means is swung a distance, and then to be swung together with the respective mandrel means; the improvement comprising means displacing each end piece outwardly during the initial bending phase and away from the bending center, to expand the pipe.

2. An apparatus as claimed in claim 1, in which said displacing means comprises portions of the respective mandrel means.

3. An apparatus as claimed in claim 2, in which on each mandrel means there is a contact surface portion facing away from the bending center for contact with a complementary contact portion on the respective end piece for transferring displacement force from the mandrel means to the end piece, the end piece and the mandrel means being mutually, limitedly pivotable about a pivoting axis between said contact portions, said axis being substantially parallel to a bending axis passing through the bending center and being disposed between the bending center and the axis of the pipe.

4. An apparatus as claimed in claim 3, in which said contact portion of the mandrel means is carried by an axially extending portion of the mandrel means situated closest to the bending center, while the contact portion of the end piece is carried by a support portion of the end piece situated substantially outside the mandrel means and adapted for contact with the inside of the pipe.

5. An apparatus as claimed in claim 1, in which the mandrel means has a stop means which, by coaction with an arcuate guiding slot in the end piece having its center of curvature at the pivoting axis, limits the mutual pivoting between end piece and mandrel means.

* * * * *